United States Patent [19]

Hayes

[11] 4,150,939

[45] Apr. 24, 1979

[54] DIFFERENTIAL CONTROLLER FOR POSITIONING COMBUSTION SYSTEM

[75] Inventor: William H. Hayes, Paramus, N.J.

[73] Assignee: Reliance Instrument Manufacturing Corp., Lodi, N.J.

[21] Appl. No.: 826,294

[22] Filed: Aug. 22, 1977

[51] Int. Cl.[2] ..... F23N 5/00

[52] U.S. Cl. ..... 431/76; 236/15 E; 122/448 R

[58] Field of Search ..... 236/15 BD, 15 E; 122/448 R; 431/76

[56] References Cited

U.S. PATENT DOCUMENTS

| | | | |
|---|---|---|---|
| 2,784,912 | 3/1957 | Scutt | 236/15 E |
| 2,980,334 | 4/1961 | Geniesse | 236/14 |
| 3,503,553 | 3/1970 | Schomaker | 236/15 E X |
| 3,549,089 | 12/1970 | Hamlett | 236/15 E |
| 3,607,117 | 9/1971 | Shaw | 236/15 E X |

OTHER PUBLICATIONS

Power, pp. 23–25, R. K. Evans, 12/1967.

*Primary Examiner*—William E. Wayner

*Attorney, Agent, or Firm*—Caesar, Rivise, Bernstein & Cohen, Ltd.

[57] ABSTRACT

A differential controller for a jackshaft or a positioning combustion system having an input shaft coupled to a fuel valve and an output shaft coupled to an air damper. The controller includes means for sensing a transmitted signal indicative of the level of oxygen in the products of combustion and in response thereto differentially adjusts the vernier position of the output shaft relative to the input shaft to provide optimum fuel use under all operating conditions. The controller includes means for precluding differential travel between the shafts at low fire (load) positions. As load demand increases the controller enables differential travel to occur with increasing demand, with the amount of differential travel permitted being a function of increasing load. The maximum range of differential travel is adjustably predetermined. The controller also includes means for determining if an alarm condition exists, whereupon an alarm signal is provided and the output shaft is returned to a preselected null position relative to the input shaft to provide for failsafe operation.

18 Claims, 8 Drawing Figures

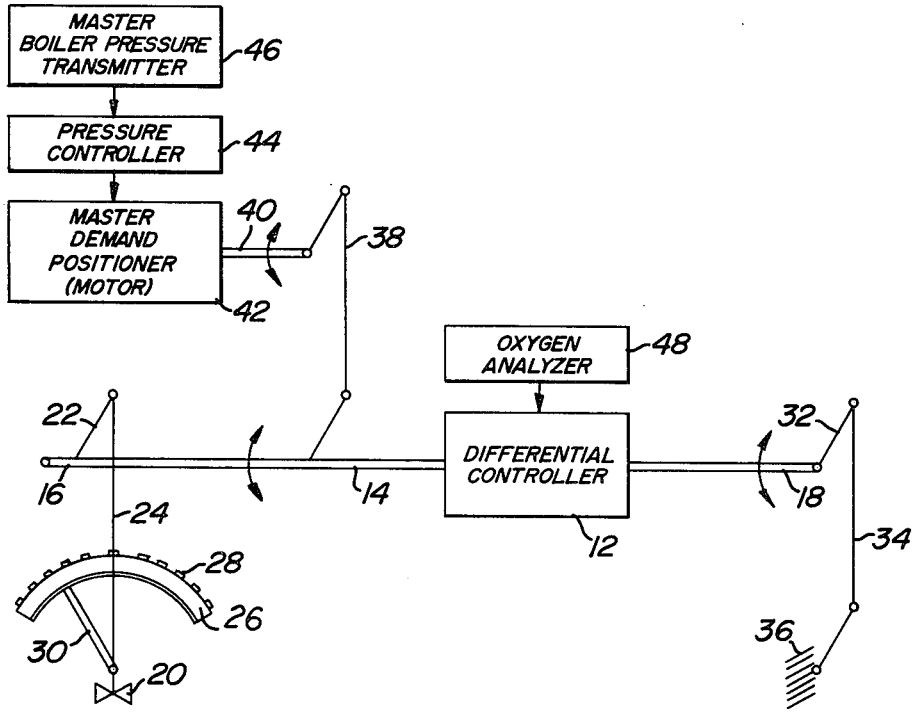

12
54
56
150
146
148
144
16
72
76
74
58
72
60
62
92
80
94
78
126
96
122
130
82
66
128
108
92
86
104
88
64
68
134
140
106
100
84
90
142
91
18
114
139
124
102
118
138
136
110
112
120
98
118
116

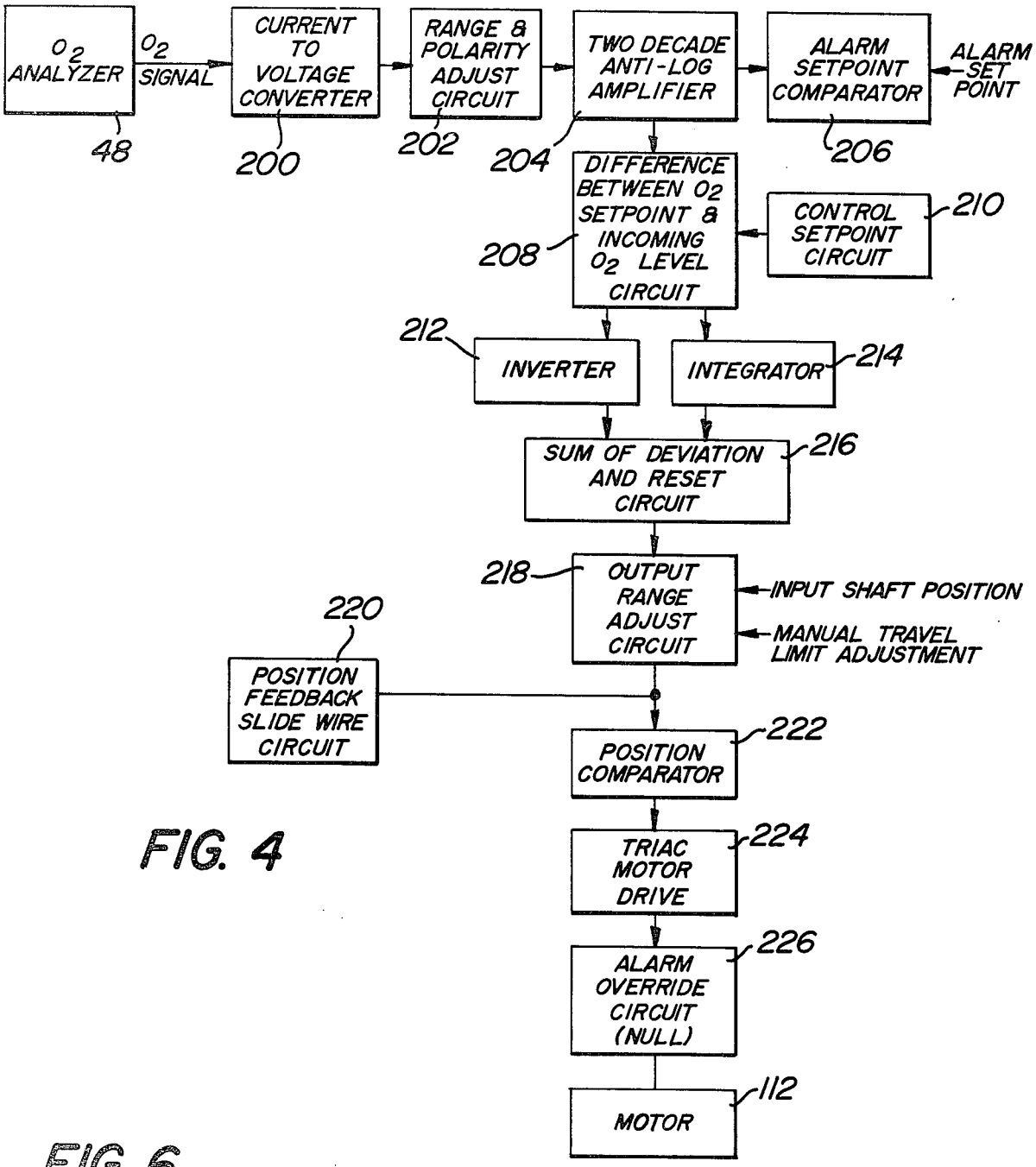
FIG. 4
FIG. 6
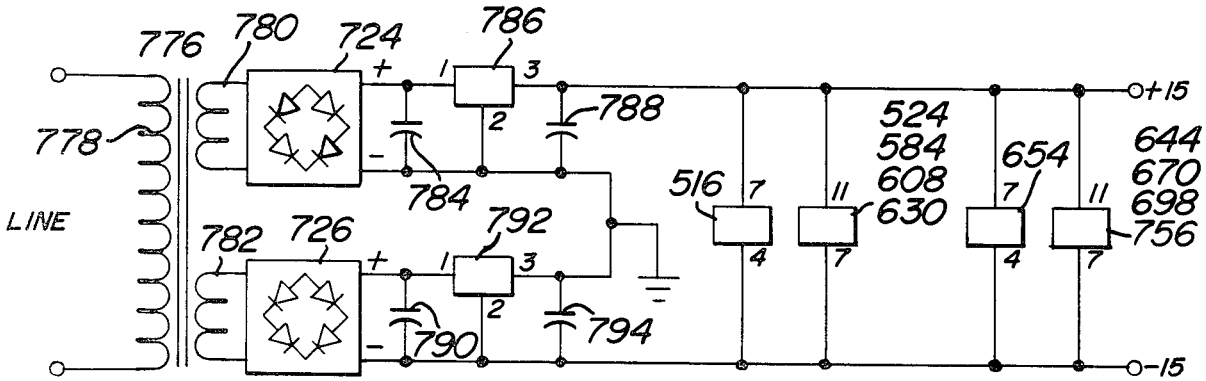

DIFFERENTIAL CONTROLLER FOR POSITIONING COMBUSTION SYSTEM

This invention relates generally to combustion control systems and more particularly to control systems for boilers, furnaces and the like utilizing rotational shafts for adjusting the fuel-air ratio to a burner in response to a monitored oxygen level.

As is known, the combustion in a boiler, furnace and the like is controlled primarily with two variables, namely, fuel flow and air flow. For any given fuel flow there is a corresponding air flow which will provide sufficient air to fully combust the fuel. If the air flow is greater than that required the burner becomes less efficient because the air that is not used in the combustion process is heated and comes out of the stack as hot air. Accordingly, the energy used to heat the air is wasted.

On small boilers and furnaces one traditional control approach has been the use of small servo motors that respond to changes in boiler steam pressure to adjust its output shaft for controlling the fuel flow.

In larger combustion systems a common control approach utilizes a rotatable shaft, e.g., a jackshaft, connected to a controller and having a pair of levers connected thereto, with one of the levers being connected, via cam means, to a fuel valve and the other lever being connected to an air damper. For each rotational position of the shaft there exists a set relationship between the amount of fuel and the amount of air provided. As is known, many variables can perturb the relationship between fuel and air. For example, a change in the viscosity of oil will result a change in the flow of oil through the valve, thereby affecting the efficiency of the combustion. Different types of oil require different amounts of air. In addition, the air itself can have greater or lesser density depending on atmospheric or temperature conditions.

Due to the variations which can occur in the fuel and air it is a traditional practice to operate the combustion system with sufficient excess air (oxygen) to cover fuel flow under worst case conditions, e.g., a hot, humid day, with high pump pressure and hot oil. If excess oxygen is not provided unnecessary smoke could result. In addition, the lack of excess oxygen in such situations may also present an explosion hazard. While the practice of using excess oxygen to preclude unnecessary smoke production results in a margin of operating safety, it detracts from operating efficiency.

Various apparatus have been disclosed in the patent literature and are commercially available for adjusting the fuel-air ratio of a burner in a combustion system. Examples of prior art combustion control systems are found in the following patents: U.S. Pat. Nos. 1,819,186 (Mayr), 2,666,584 (Kliever), 2,784,912 (Scutt), 2,804,267 (Hahn et al), 2,980,334 (Geniesse), 3,368,753 (Baumgartel et al), 3,391,866 (Rohrer), 3,469,780 (Woock), 3,607,117 (Shaw) and 3,960,320 (Slater).

While prior art combustion control systems have attempted to provide for optimum efficiency while operating safely, such systems nevertheless leave much to be desired from a practical standpoint. This is particularly true in systems wherein a single rotatable shaft or coupled rotatable shafts are utilized to effect the opening or closing of the fuel valve and air damper at different operating points.

One technique for attempting to optimize burner efficiency in combustion systems utilizing rotatable shafts coupled to the fuel valve and air damper has been to provide differential rotation between the shaft coupled to the fuel valve and the shaft coupled to the air damper in response to the level of oxygen monitored in the stack. While such a technique goes a long way toward optimizing burner efficiency within safe limits, such a prior art technique still leaves much to be desired.

Accordingly, it is a general object of the instant invention to provide a differential controller for use in a jackshaft combustion control system and which overcomes the disadvantages of the prior art.

It is a further object of the instant invention to provide a combustion control system enabling the minimization of fuel wastage through the use of excess air while maintaining allowances for natural variations in fuel and air characteristics.

It is still a further object of the instant invention to provide in a combustion system a full metering vernier control of either air or fuel flow based on actual combustion products and wherein vernier control does not occur under low burner fire conditions but is permitted to occur in increasing amounts as the burner fire increases to adjust for maximum efficiency.

It is yet a further object of the instant invention to provide in a combustion control system having vernier rotation to effect maximum operating efficiency and having means for overriding the vernier rotation to return the system to a null position in response to an alarm condition.

These and other objects of the instant invention are achieved by providing in a combustion control system including a stack through which products of combustion pass, a first rotating shaft portion coupled to means for adjusting the flow of fuel through a fuel valve and a second rotating shaft portion coupled to means for adjusting the flow of air through a damper, with the first and second shaft portions being arranged to rotate together from a low fire position to a high fire position to establish the fuel-air ratio for all positions therebetween. A differential controller is provided for effecting differential vernier rotation between the first and second shaft positions to enable the fuel to be burned efficiently irrespective of changes in fuel or air provided. The differential controller comprises means for comparing the oxygen level in the stack with a preselected oxygen level and for effecting the differential vernier rotation of the second shaft portion with respect to the first shaft portion when there is a deviation from said preselected level to adjust the oxygen level to said preselected level. Means are provided for adjusting the gain of the differential controller to enable greater vernier rotation as the first shaft portion is rotated from a low fire position to a higher fire position. Override means are also provided to cause the second shaft portion to assume a a predetermined null position with respect to the first shaft portion in response to an alarm condition.

Other objects and many of the attendant advantages of this invention will be readily appreciated as the same becomes better understood by reference to the following detailed description when considered in connection with the accompanying drawings wherein:

FIG. 4 is a functional block diagram of the electrical components forming the differential controller of the instant invention;

FIG. 6 is a schematic diagram of the power supply for the electrical system of the differential controller of the instant invention.

Figure 1:
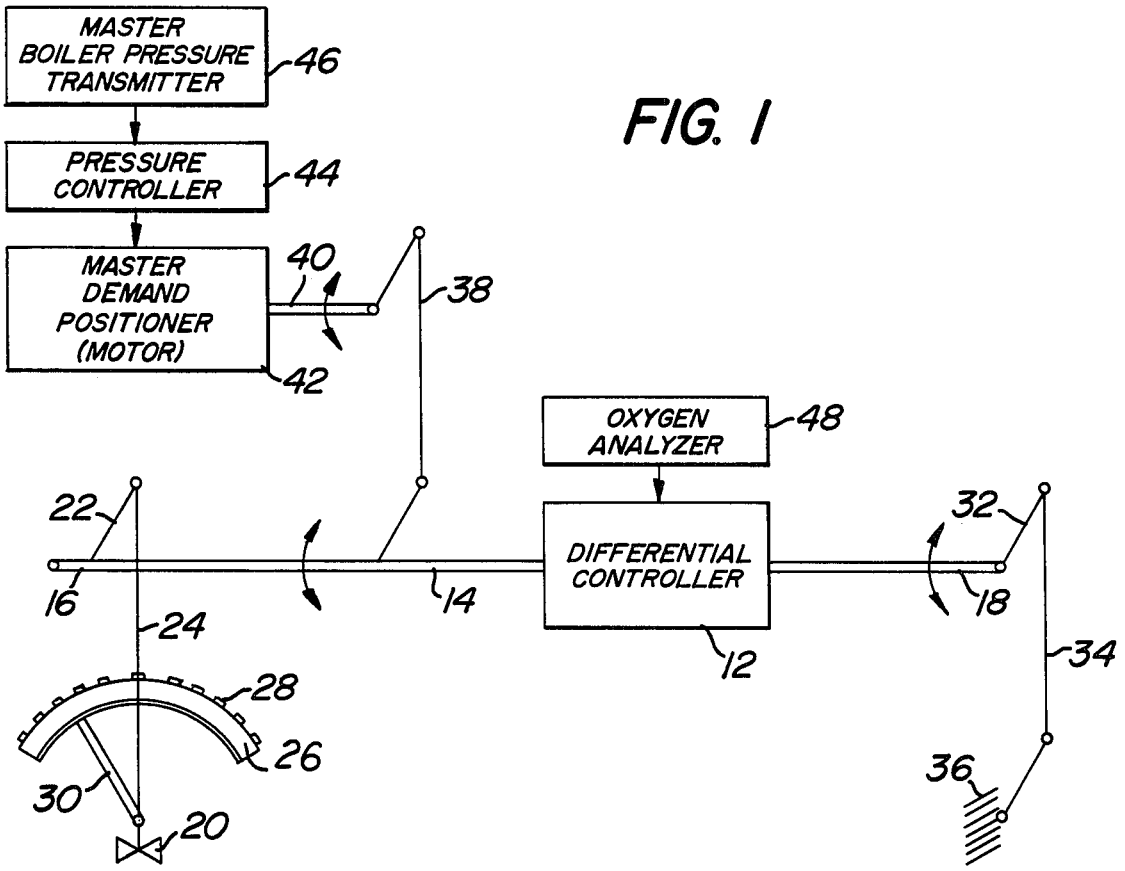
FIG. 1 is a schematic diagram of one type of jackshaft combustion control system utilizing the differential controller of the instant invention.

Referring now the various figures of the drawing wherein like reference characters refer to like parts, there is shown in FIG. 1 a combustion control system 10 such as utilized for controlling combustion of a large boiler. The system 10 includes a differential controller 12 connected to a jackshaft 14. The jackshaft 14 includes a first end 16 and a second end 18. The ends 16 and 18 are connected together mechanically within the differential controller 12. The lever 22 is connected to the first end 16 and is coupled, via linkage means 24, to characterizable cam means 26. The cam means includes a plurality of adjustment screws 28 which are adjusted to shape or characterize the cam. A rotating member 30 coupled to the linkage means 34 is adapted to be rotated along the cam surface as contoured by the characterizing screws and is coupled to a fuel valve 20 to dimension the orifice (not shown) within the valve in accordance with the position of the rotatable arm 30 of the cam, and hence with the rotational position of the shaft end 16. Shaft end 18 has connected to it a lever arm 32 which is coupled, via linkage means 34, to an air damper 36 to adjust the flow of air therethrough in accordance with the rotational position of shaft end 18. The rotation of shaft 14 is accomplished by a levered linkage assembly 38 connected to a rotatable shaft 40. The shaft 40 is an output shaft of a master demand positioner or motor 42. The rotational position of output shaft 40 is established under the control of a conventional pressure controller 44. The controller 44 operates to control the position of shaft 40 in response to a signal provided from a conventional master boiler pressure transmitter 46.

Operation of the system shown in FIG. 1 and described heretofore, is as follows: the master pressure transmitter 46 senses the steam pressure in the boiler which is generated by the burner's combustion of fuel and air. The pressure controller 44 compares the sensed pressure signal with the predetermined pressure desired in the boiler (called setpoint pressure) to effect the rotation of the shaft 40 of motor 42 to the desired rotational position. The rotational positioning of shaft 40 is coupled, via the linkage lever assembly 38, to the shaft 14 to rotate it to a corresponding position. As will be seen in detail later, the differential controller 12 enables shafts 16 and 18 to rotate together as a unit as well as enabling differential rotation, hereinafter called vernier rotation, between the two ends. This differential rotation enables the optimization of the combustion at firing positions in excess of a low fire condition of the burner (to be described hereinafter).

In practice the amount of fuel admitted through the valve 22 to the burner is adjusted for each rotational position of the shaft 14, via the adjustment of screws 28. This action is accomplished starting with the shaft 14 rotated to what is known as the low fire position, namely, the lowest fuel input to the burner that will maintain a flame. With the shaft in this position the damper 36 is adjusted until an appropriate air flow is achieved to maintain the flame. The shaft 14 is then rotated to open the valve 20 and air damper 36 further. As the shaft is rotated through each increment an associated characterizing screw 28 is adjusted to establish the size of the valve orifice for that rotational position. Once the characterizing of the cam 26 has been achieved the system is operative to provide a given fuel flow for a given air flow.

As noted heretofore, the physical properties of the fuel and air introduce variables that can perturb the predetermined relationship between the fuel and air as set up.

The differential controller is designed to provide optimum fuel use under all operating conditions. To that end, the differential controller 12 maintains a constant oxygen level setpoint by monitoring an oxygen level signal provided from a conventional oxygen analyzer 48 mounted within the stack. Depending upon the level of oxygen monitored the differential controller 12 effects the rotation of shaft end 18 with respect to shaft end 16 to maintain the oxygen setpoint. The amount of differential travel is a function of the burner load with the differential vernier movement, referred to as the trim function, being derived from a transmitted oxygen signal from the oxygen analyzer 48.

As will be described in detail hereinafter, at low fire rotational positions of the shaft 14, flame stability is substantially more important than the control of excess air necessary for optimizing burner efficiency. Under such circumstances and under "light off" conditions the differential controller provides no trimming function. As the burner demand increases and more fuel is needed the differential controller provides greater differential vernier travel (trim) which is coupled through the linkage to the air damper 36. At higher fire positions of the shaft 14 the differential controller 12 controls the differential rotational position within predetermined operating limits that have been set in the controller, as will be described later. The differential controller also includes means for providing an alarm setpoint that automatically returns the shaft end 18 to a preset safe or null position with respect to shaft 16 in the event of an electrical failure in the controller power supply, in the oxygen analyzer or in the event of the detection of a true low oxygen condition, thereby providing for failsafe operation.

Figure 2:
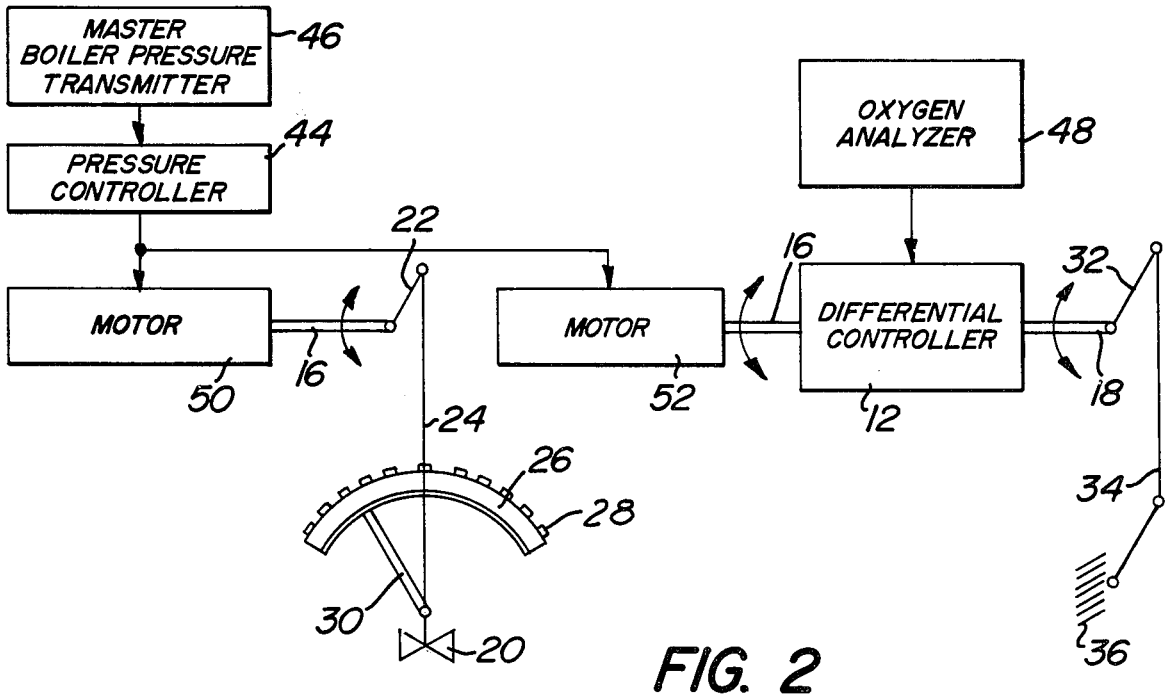
FIG. 2 is a schematic diagram of another type of combustion control system in which the differential controller of the instant invention is utilized.

In FIG. 2 there is shown a variant combustion system utilizing the differential controller 21 of the instant invention. As can be seen therein, the system includes a pair of motors 50 and 52 each having an output shaft 16. The motor 50 and 52 are each operated under the control of the pressure controller 44 in the same manner as described heretofore with regard to shaft 14 to effect the rotational positioning of each of their output shafts 16. As can be seen, the output shaft 16 of motor 50 is coupled, via lever 22 and associated linkage 24, to cam 26 in the same manner as described heretofore. Accordingly, the rotational positioning of shaft 16 controls the size of the orifice of valve 20. The output shaft 16 of motor 52 is connected to the differential controller 12 in the same manner as end portion 16 of shaft 14 described with regard to FIG. 1. The air damper 36 is opened or closed in accordance with the rotational position of shaft 18 as coupled through lever 32 and linkage 34. Motor 50 and motor 52 are operated in unison so that the rotational position of their output shafts 16 is such that fuel valve 20 and damper 36 are operated in the same manner as described with regard to the system of FIG. 1. As in the system of FIG. 1, the differential controller 12 enables differential positioning between shaft portion 16 and shaft portion 18 to permit the safe and efficient optimization of the combustion process.

Figure 3:
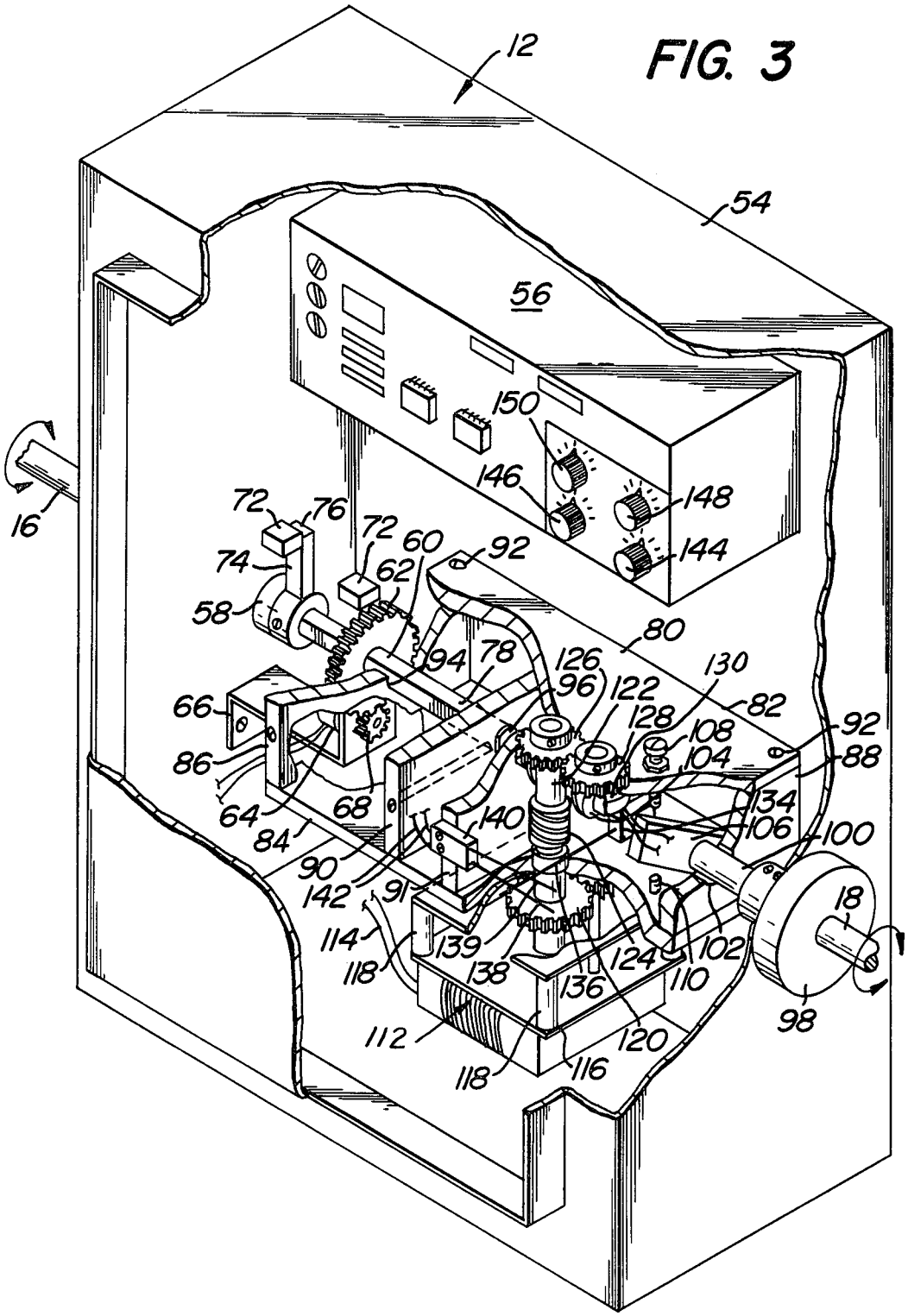
FIG. 3 is a perspective view, partially in section, showing the mechanical details of the differential controller of the instant invention.

In FIG. 3 there is shown structural details of the differential controller 12.

As can be seen therein, controller 12 is housed within an oil-tight, metal housing 54. The electronics package of the differential controller, identified generally by the reference numeral 56, is mounted within the upper portion of housing 54. The mechanical input to the differential controller is provided by shaft 16. To that end, shaft 16 extends through a bearing 58 mounted in the side wall of housing 54. The portion of shaft 16 extending within the interior of housing 54 includes a flatted portion 60. A gear 62 is fixedly mounted on the flatted portion of shaft 16 extending within the housing and adjacent to bearing 58. A potentiometer 64 is mounted on a bracket 66 on the side wall of housing 54. The shaft (not shown) of the potentiometer 64 has a gear 68 mounted on it which mates with the gear 62. An electrical signal is provided, via associated conductors, between the potentiometer and the electronics package 56, which signal indicates the rotational position of the input shaft 16.

Since jackshafts for combustion control systems are generally rotated only through an arc of approximately 90°, a pair of stops 72 displaced by 90° from each other are mounted on the inside wall of the housing 54. A shaft stop 74 is mounted on shaft 16 immediately adjacent bearing 58 and includes a radially extending arm 76. The stop 74 is fixedly secured to the shaft and limits the rotation of the shaft to an arc of 90° between the two block stops 72. At the free end 78 of shaft portion 16 extending within housing 54 there is mounted a differential controller frame 80. The frame 80 includes a pair of side plates 82 and 84, a pair of end plates 86 and 88 and a pair of intermediate plates 90 and 91 disposed parallel to and between the end plates 86 and 88. The side plates, end plates and intermediate plates are connected together to form an integral frame, via a plurality of screws 92. The frame 80 includes a pair of aligned openings 94 and 96 in walls 86 and 84, respectively. The free end portion 78 of input shaft 16 extends through the aligned openings 94 and 96 and the frame 80 is secured to shaft portion 78, via plural set screws (not shown). Accordingly, the rotation of shaft 16 effects the concomitant rotation of frame 80 about the axis of shaft 16.

The output shaft 18 extends through a bearing 98 in the opposed side wall of housing 54. The free end portion of shaft 18, which extends into the interior of the housing 54 is denoted by the reference numeral 100. As can be seen, shaft portion 100 extends through an opening 102 in the end wall 88 of the frame 80. Free end 100 of shaft 18 terminates in a gear 104. The shaft 100 is not secured to the frame 80 and can be rotated through a limited arc defining the maximum differential travel relative to shaft 16. To that end, fixedly secured to shaft 100 is a radially extending finger 106. A pair of differential travel stop screws 108 and and 110 are mounted on side walls 82 and 84, respectively, and extend toward each other to define and adjustable gap therebetween. The finger 106 is disposed within the gap between screws 108 and 110. Accordingly, the fingers 108 and 110 mechanically provide the maximum limits of rotational travel of shaft 18 with respect to frame 80 and hence shaft 16.

The rotation of shaft 18 is produced by electrical motor 112. Power for the motor is provided via conductors 114 from the electronics package 56. The motor 112 is mounted on a plate 116, via plural standoffs 118, from wall 84. The output shaft of the motor is coupled, via a gear train 120, to shaft 122. Shaft 122 has mounted thereon a worm gear 124 which coacts with gear 104 mounted on the free end 100 of shaft 18. Accordingly, the operation of the motor 112 rotates shaft 18 about its axis either clockwise or counter-clockwise, depending upon the direction of rotation of the output shaft of the motor.

As can be seen, the free end of shaft 122 extends outside of frame 80 and terminates in a gear 126. Gear 126 mates with a gear 128 which is connected to the rotary shaft of a potentiometer 130 mounted on the frame 80. The potentiometer 130 is electrically connected, via conductors 132, to the electronics package 56 and is arranged to provide an indication of the rotational position of shaft 18 with respect to frame 80 and hence input shaft 16.

The differential controller 12 includes means for bringing the shaft 18 to the predetermined safe rotational position with respect to shaft 16, called a null position, in the event of the existence of an alarm condition. To that end, the differential controller 12 includes a single pole, double throw nulling switch assembly having a center dead band and comprises a block 134 having a contact arm 136 projecting therefrom and between a pair of fixed contact arms 138 and 139 mounted on a mounting block 140. The electrical connection to the fixed contacts 138 and 139 is provided, via a pair of conductors 142, which extend to the electronics package 56. The movable contactor 137 is electrically connected to the electronics package by a conductor (not shown). The mounting block 140 is mounted on the end face of intermediate wall 91. The rotating block 134 is fixedly secured to the free end portion 100 of shaft 18 and is adapted to rotate therewith. In the null position the movable contactor 136 is disposed between the stationary contacts 138 and 139 but not in contact with either one of them. As the shaft 18 is rotated either clockwise or counter-clockwise from the null position the movable contact 136 makes electrical contact with either the stationary contact 138 or the stationary contact 139, depending upon whether the shaft 18 is rotated counterclockwise or clockwise.

The electronics package 56 includes plural adjustment knobs for establishing the operating characteristics of the differential controller 12. To that end, an adjustment knob 144 is provided to establish the permissible limit of differential travel, up to a maximum of +/−10°. A knob 146 is provided to establish the alarm setpoint, that is the acceptable threshold level for oxygen within the stack before an alarm signal is given. A knob 148 is provided to establish the setpoint for the system utilizing oil as fuel, that is the desired oxygen level within the stack when the oil is burned as fuel. A similar knob 150 is provided to establish the setpoint for gas burners.

Operation of the differential controller 12 is as follows:

Assuming that the electronics package 56 determines that no differential control (trim) is necessary or that the combustion system is operating at a low fire point the shaft 18 is rotated through the same degree of arc as shaft 16 in the following manner: as the flame is increased under the control of the pressure controller 44 either the master demand positioner 40 of the system shown in FIG. 1 or the motors 50 and 52 of the system shown in FIG. 2 begin rotation to cause the fuel control valve 20 connected to shaft 16 to open wider, thereby increasing the flow of fuel to the burner. Since the shaft 16 is fixedly secured to frame 80 within the housing 54 of the differential controller, the rotation of shaft 16 through some predetermined arc effects the concomitant rotation of frame 80 about the axis of shaft 16 through the same arc. The motor 112 is mounted on the frame 80 and is arranged to hold output gear 124 at its last established rotational position. Since worm gear 124 is engaged with gear 104 on the free end 100 of shaft 18 the rotation of frame 80 through the arc causes the concomitant rotation of shaft 18 about its axis through the same arc. The rotation of shaft 18 is coupled, via lever 32 and linkage 34, to damper 36 to effect the predetermined opening of the damper to enable the desired amount of oxygen to flow to the burner.

All the while that the burner is in operation the electronics package 56 monitors the oxygen level within the stack from the signal provided by the oxygen analyzer. In the event that there is a deviation from the preselected oxygen level the electronics package provides a suitable signal to the motor 112 to rotate its output shaft and hence worm gear 124 either clockwise or counterclockwise. The rotation of gear 124 causes the rotation of shaft 100 relative to frame 80. The rotation of worm gear 124, and hence shaft 18, is sensed by potentiometer 130 and provides a signal back to the electronics package. When the electronics package determines that output shaft 18 has been adjusted through a differential arc to establish the desired oxygen level within the stack, the electronics package 56 ceases providing a motor rotational signal.

In the event that the level of oxygen monitored in the stack drops below the alarm set point as established by knob 146 the electronics package 56 provides an alarm signal. In addition, if the output shaft 18 had been in any rotational position other than the null position the movable contactor 136 would have been in contact with either fixed contact 138 or fixed contact 139. The electrical connection between movable contact 136 and either fixed contact 138 or fixed contact 139 provides a signal which, if there is an alarm condition existing, is utilized to drive the motor 112 to rotate the shaft until the movable contact 136 breaks the connection with either fixed contact 138 or fixed contact 139 with which it had been in contact. Once the connection is broken the further rotation of the motor ceases and the shaft 18 is returned to its null position. If the null position is established such that output shaft 18 is in phase with input shaft 16 the effect of being in the null position is as if shafts 16 and 18 were connected together with the differential controller 12 being out of the system. It should be pointed out at this juncture that the null position can also be established at other points such that there is a relative displacement between the input shaft 16 and output shaft 18. For example, the null position could be set up to increase air flow to the maximum differential movement as allowed by the controller, e.g., 10°, when an alarm condition occurs. Accordingly, the differential controller is a failsafe device which enables the output shaft to return to a preset safe setting in the event of an alarm condition. As noted heretofore, the alarm condition can arise when there is a substantial decrease in the oxygen level, a failure in the oxygen analyzer or a failure in the power supply to the differential controller.

As noted heretofore, the differential controller 12 is a variable gain device, that is it permits greater differential rotation of shaft 18 with respect to shaft 16 as the fire of the burner is increased. To that end, the potentiometer 64 senses the rotational position of shaft 16, e.g., whether it is at a low fire point, an intermediate point, a high fire point, and provides a signal, via its associated conductors, to the electronics package 56. As the shaft rotates to higher fire positions more and more differential control of shaft 18 is permitted by the electronics package until full differential control is enabled.

The maximum degree of differential rotation is established by the setting of knob 144 in the electronics package 56. In accordance with a preferred embodiment of the instant invention the control setpoint, be it either gas or oil, is adjustable from 0.1% to 10% and is normally operated in the range of 2% to 4%, depending on the maximum efficiency attainable from the individual boiler and burner combination. The alarm setpoint is normally set at 1% or 2% below the control setpoint.

The overall operation of the electronics package 56 can best be understood by reference to FIG. 4. As can be seen therein, the electronics package comprises a Current-To-Voltage Converter Circuit 200 which is connected to a Range And Polarity Adjusting Circuit 202. The Range and Polarity Adjusting Circuit is connected to a Two Decade Antilog Amplifier 204. The Two Decade Antilog Amplifier is connected to an Alarm Setpoint Comparator 206 and to a Difference Between Oxygen Setpoint And Incoming Oxygen Level Circuit 208. The circuit 208 is connected to a Control Setpoint Circuit 210 and also to an Inverter circuit 212 and an Integrator Circuit 214. Both the Inverter 212 and the Integrator 214 are connected to a Sum Of Deviation And Reset Circuit 216. The circuit 216 is connected to an Output Range Adjust Circuit 218. The circuit 218 is connected to a Position Feedback Slide Wire Circuit 220 and to a Position Comparator Circuit 222. The position comparator is connected to a Triac Motor Drive Circuit 224. The Triac Motor Drive Circuit is connected to an Alarm Override Circuit 226, which is in turn connected to the motor 112.

The oxygen analyzer 48 is of a conventional type such as the zirconium dioxide electrochemical cell type and provides a logarithmic current signal which decreases with increasing oxygen concentration. The signal is provided as an input to the Current-To-Voltage Converter Circuit 200. The converter circuit 200 converts the current signal to a voltage signal for compatibility with the remaining circuitry within the electronics package. The output of the current-to-voltage converter, that is the logarithmic voltage signal indicative of the oxygen level in the stack is provided to the Range And Polarity Adjusting Circuit 202. This circuit adjusts the range and polarity of the input signal for compatibility with the antilog amplifier 204. The Two Decade Antilog Amplifier 204 converts the logarithmic voltage signal to a linear signal. The linear oxygen signal is provided as an input to the Alarm Setpoint Comparator Circuit 206. This circuit compares the linearized signal to an alarm setpoint signal as previously established by the setting of the alarm setpoint knob 146 which is connected to a potentiometer (to be described in detail later). The Alarm Setpoint Comparator Circuit provides an alarm signal in the event that the linearized signal from the antilog amplifier is below the alarm setpoint level.

The Two Decade Antilog Amplifier 204 also provides the linearized signal indicative of the oxygen level to the Difference Between Oxygen Setpoint And Incoming Oxygen Level Circuit 208. The circuit 208 operates to provide an error signal equal to the difference between the predetermined oxygen level, e.g., the gas or oil setpoint, and the linearized oxygen level signal as provided by the antilog amplifier 204. To that end, the circuit 208 receives as an input a control setpoint signal from control setpoint circuit 210. The control setpoint for gas is established by the setting of knob 150 associated with a potentiometer (to be described later) while the control setpoint for oil is established by the setting of knob 148 associated with another potentiometer (to be described later).

The error signal indicating the difference between the preselected oxygen level and the actual oxygen level is provided as an input to an Inverter Circuit 212 and also as an input to an Integrator Circuit 214. The inverter 212 merely inverts the error signal to provide a "Deviation" signal while the integrator performs real time integration on the error signal to provide a "Reset" signal. The Deviation signal from the inverter 212 and the Reset signal from the integrator 214 are provided as inputs to the Sum of Deviation And Reset Circuit 216. This circuit sums the signals to provide a two mode control signal. By two mode control signal it is meant a signal comprising two components, one component of which being proportional to the measured error signal and the other component being proportional to the real time integral of the error signal. The two mode control signal is provided as an input to the Output Range Adjust Circuit 218. This circuit adjusts the range or algebraic scale of the two mode control signal to provide an output signal indicating the position that the controller 212 is calling for to establish the optimum oxygen level. The Output Range Adjust Circuit 218, as will be seen in detail later, includes an analog multiplier to vary the gain of the circuit from zero to one, with the gain increasing with increased rotational position of the input shaft 16. To that end, the circuit 218 includes an input from the input shaft position potentiometer 64. The output range adjust circuit also includes another analog multiplier to vary the gain from zero to one as preset by a travel adjustment potentiometer (to be described later) coupled to the knob 144 of the electronics package. The Output Range Adjust Circuit provides a signal indicating the desired vernier position of output shaft 18 and is a function of the rotational position of the input shaft 16 and is limited by the preselected setting of the manual limit adjustment (e.g., between 1° and 10° total vernier rotation).

The position Feedback Slide Wire Circuit 220 provides a signal indicating the actual vernier rotational position of the output shaft 18. To that end, the circuit 220 includes the output position sensing potentiometer 130 described heretofore. The actual vernier position signal as provided by the circuit 220 is compared with the desired vernier position signal from the Output Range Adjust Circuit 218 in the Position Comparator Circuit 222. The comparator circuit 222 provides an output signal used by the Triac Motor Drive to control the driving of the motor 112 in one direction or the other until the vernier position signal as sensed by the slide wire circuit 220 equals the desired vernier position signal as provided by the Output Range Adjust Circuit 218.

The Alarm Override Circuit 226 includes the nulling switch described heretofore and receives a signal from the Alarm Setpoint Comparator Circuit 206 indicating the existence of an alarm condition to cause the nulling switch to take over control of the motor 112 from the Triac Motor Drive 224 to bring the motor back to the null position.

Figure 5A:
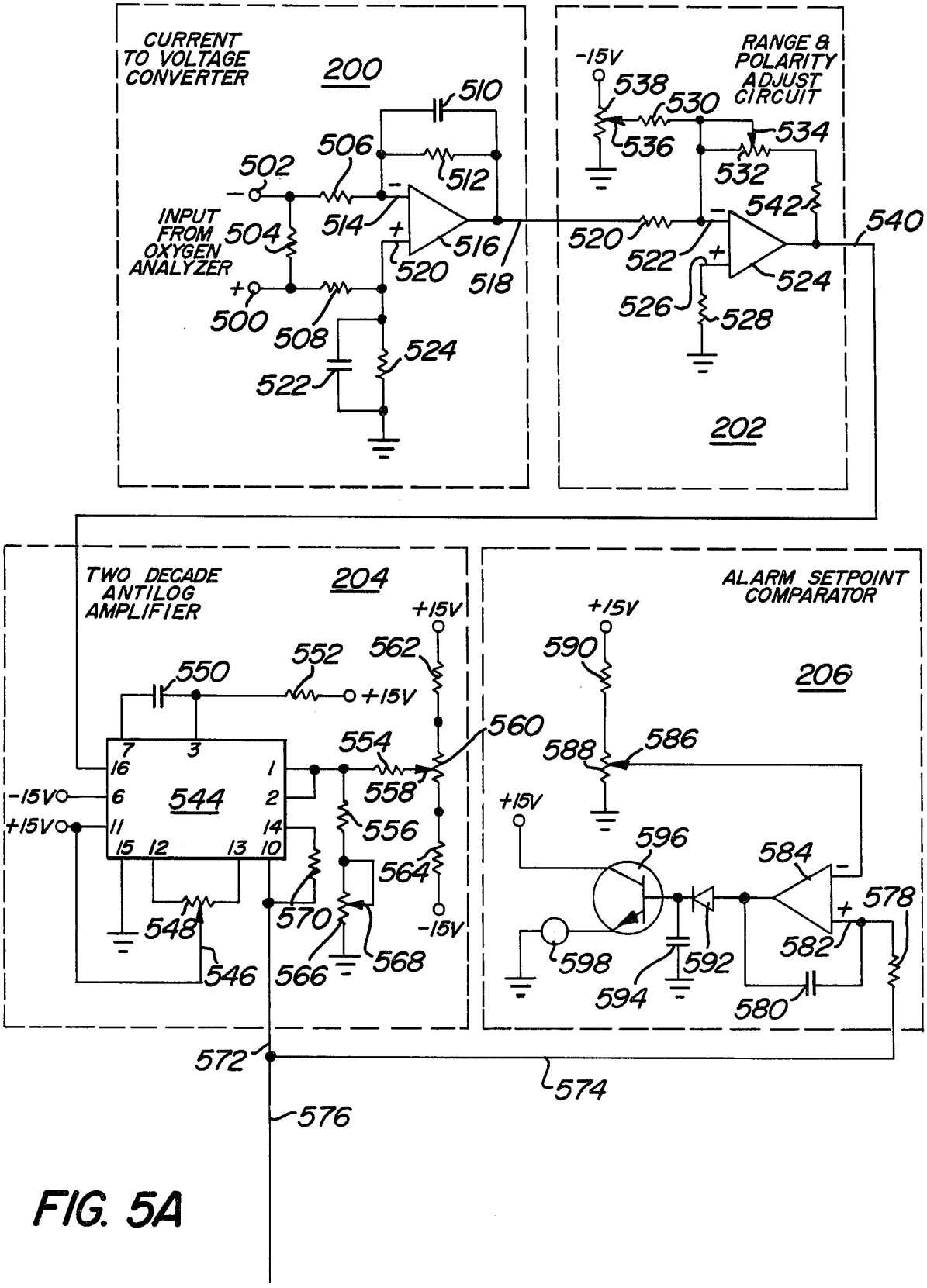
FIGS. 5A, 5B and 5C are schematic diagrams showing the details of the functional block diagram shown in FIG. 4.

As can be seen in FIG. 5A, the Current-To-Voltage Converter Circuit 200 is provided with a signal from the oxygen transmitter across positive input terminal 500 and negative input terminal 502. A resistor 504 is connected between terminals 500 and 502. Another resistor 506 is connected to the common point of resistor 504 and terminal 502. In a similar manner another resistor 508 is connected to the common junction of the other side of resistor 504 and positive terminal 500. The other side of resistor 506 is connected to the common point of one side of a capacitor 510, one side of a resistor 512 and to the inverting input terminal 514 of an operational amplifier 516. The operational amplifier 516 is preferably formed of one portion of a combined integrated circuit pack (e.g., RCA Model CA3140). The output of amplifier 516 is provided at line 518 and is connected to the other side of resistor 512 and the other side of capacitor 510. The non-inverting input terminal 520 of amplifier 516 is connected to the other side of resistor 508 and to the common junction of one side of a capacitor 522 and one side of a resistor 524. The other side of capacitor 522 and the other side of resistor 524 are connected together to ground.

As will be appreciated by those skilled in the art, the operational amplifier 516 is set up as a differential amplifier with a gain of one. The gain is established by the ratio of resistors 506/512 and 508/524. The capacitors 510 and 522 serve to attenuate high frequencies.

The output signal appearing on line 518 is a voltage signal which is a logarithmic function of the oxygen level sensed by the oxygen analyzer. The signal appearing on line 518 is connected as an input to the Range And Polarity Adjust circuit 202. As can be seen, circuit 202 comprises an input resistor 520, one side of which is connected to line 518. The other side of resistor 520 is connected to the inverting input terminal 522 of an integrated circuit operational amplifier 524. The operational amplifier 524 is preferably one portion of a combined integrated circuit pack e.g., Raytheon Model RC4136. The non-inverting input terminal 526 of amplifier 524 is connected to one side of a resistor 528, the other side of which is connected to ground. The inverting input terminal 522 of amplifier 524 is also connected to one side of a resistor 530 and to the common point of one side of potentiometer 532 and its wiper arm 534. The other side of resistor 530 is connected to a wiper arm 536 of a potentiometer 538. One side of the potentiometer 538 is connected to a −15V bus and the other side is connected to ground. The output of the amplifier 524 is connected to line 540. A resistor 542 is connected between the potentiometer 532 and line 540.

The operational amplifier 524 of the Range And Polarity Adjust Circuit 202 is set up as an inverting amplifier with resistor 520 serving as the input resistor and potentimeter 532 establishing the gain. The potentiometer 538 sets up a bias voltage which biases the output appearing on line 540, via potentiometer 532 and resistors 542 and 530. Resistor 528 reduces the error from the input bias current.

The Two Decade Antilog Amplifier Circuit 204 converts the logarithmic voltage signal which is indicative of the oxygen level to a linear signal. To that end, circuit 204 includes an integrated circuit antilog amplifier 544. Preferably circuit 544 is an Intersil Model 8049. The pin connections for the integrated circuit 544 are as shown in FIG. 5A. To that end, as can be seen, pin 6 is connected to a −15V bus and pin 11 is connected to a +15V bus. Pin 11 is also connected to the wiper arm 546 of a potentiometer 548. One side of potentiometer 548 is connected to pin 12 while the other side is connected to pin 13. Pin 16 serves as the input to the antilog amplifier 544 and is thus connected to line 540. A capacitor 550 is connected between pins 7 and 3 of the integrated circuit 544. Pin 3 is also connected to one side of a resistor 552, the other side of which is connected to +15V bus. Pins 1 and 2 are connected together to the common junction of a resistor 554 and a resistor 556. The other side of resistor 554 is connected to wiper arm 558 of a potentiometer 560. One side of potentiometer 560 is connected to one side of a resistor 562, the other side of which is connected to a +15V bus. The other side of potentiometer 560 is connected to one side of a resistor 564, the other side of which is connected to a −15V bus. The other side of resistor 556 is connected to the common junction of one side of a potentiometer 566 and its wiper arm 568. The other side of potentiometer 566 is connected to ground. A resistor 570 is connected between pins 10 and 14, with pin 10 being connected to output line 572.

As will be appreciated by those skilled in the art, the potentiometer 566 establishes the reference current for the integrated circuit 544. Capacitor 550 is provided for stabilizing purposes. The potentiometer 548 serves to caliberate the offset of the amplifier. The resistor 570 sets the output voltage while resistors 562, 560 and 564 set up a bias voltage through resistor 554 to set the full scale of the log amplifier 544. Resistors 556 and 566 trim the mid-scale reading of the amplifier.

The linear signal produced by circuit 204 is provided on line 572 and from there as inputs to the Alarm Setpoint Comparator Circuit 206 and the Difference Between Oxygen Setpoint And Incoming Oxygen Level Circuit 208. To that end, line 572 is connected to line 574 which serves as the input to the Alarm Setpoint Comparator Circuit and is also connected to line 576 which serves as the input to the Difference Between Oxygen Input Setpoint And Incoming Oxygen Level Circuit 208.

As can be seen in FIG. 5A, the Alarm Setpoint Comparator Circuit 206 includes an input resistor 578 connected to line 574. The other side of resistor 578 is connected to the common junction of one side of a capacitor 580 and the non-inverting input terminal 582 of an operational amplifier 584. The operational amplifier 584 is preferably another portion of the combined integrated circuit pack forming amplifier 524. The inverting input terminal of the operational amplifier 584 is connected to the wiper arm 586 of a potentiometer 588. One side of potentiometer 588 is connected to ground and the other side is connected to one side of a resistor 590. The other side of resistor 590 is connected to a +15V bus. The output of integrated circuit 584 is connected to the other side of capacitor 580 and to the anode of a diode 592. The cathode of diode 592 is connected to one side of a capacitor 594 and to the base of a transistor 596. The other side of capacitor 594 is connected to ground. The collector of transistor 596 is connected to a +15V bus. The emmitter of transistor 596 is connected to ground, via a relay coil 598.

The Alarm Setpoint Comparator Circuit, as noted heretofore, compares the linearized oxygen signal to the alarm setpoint (that is the percentage of oxygen level which will be acceptable before an alarm signal is provided) and is established by the setting of potentiometer 588 (connected to knob 146). The resistor 590 serves to drop the voltage provided to potentiometer 588. The linearized oxygen level signal appearing on line 574 is provided to the non-inverting input terminal 582 of the operational amplifier 584. The resistor 578 and the capacitor 580 serve as a high frequency filter for the operational amplifier.

When the oxygen level drops below the alarm setpoint transistor 596 is rendered non-conductive by the output of integrated circuit 584, whereupon relay coil 598 is deenergized. The deenergization of relay coil 598 causes the creation of an alarm signal and also effects the nulling operation of the Alarm Override Circuit 226, to be described in detail later.

Figure 5B:
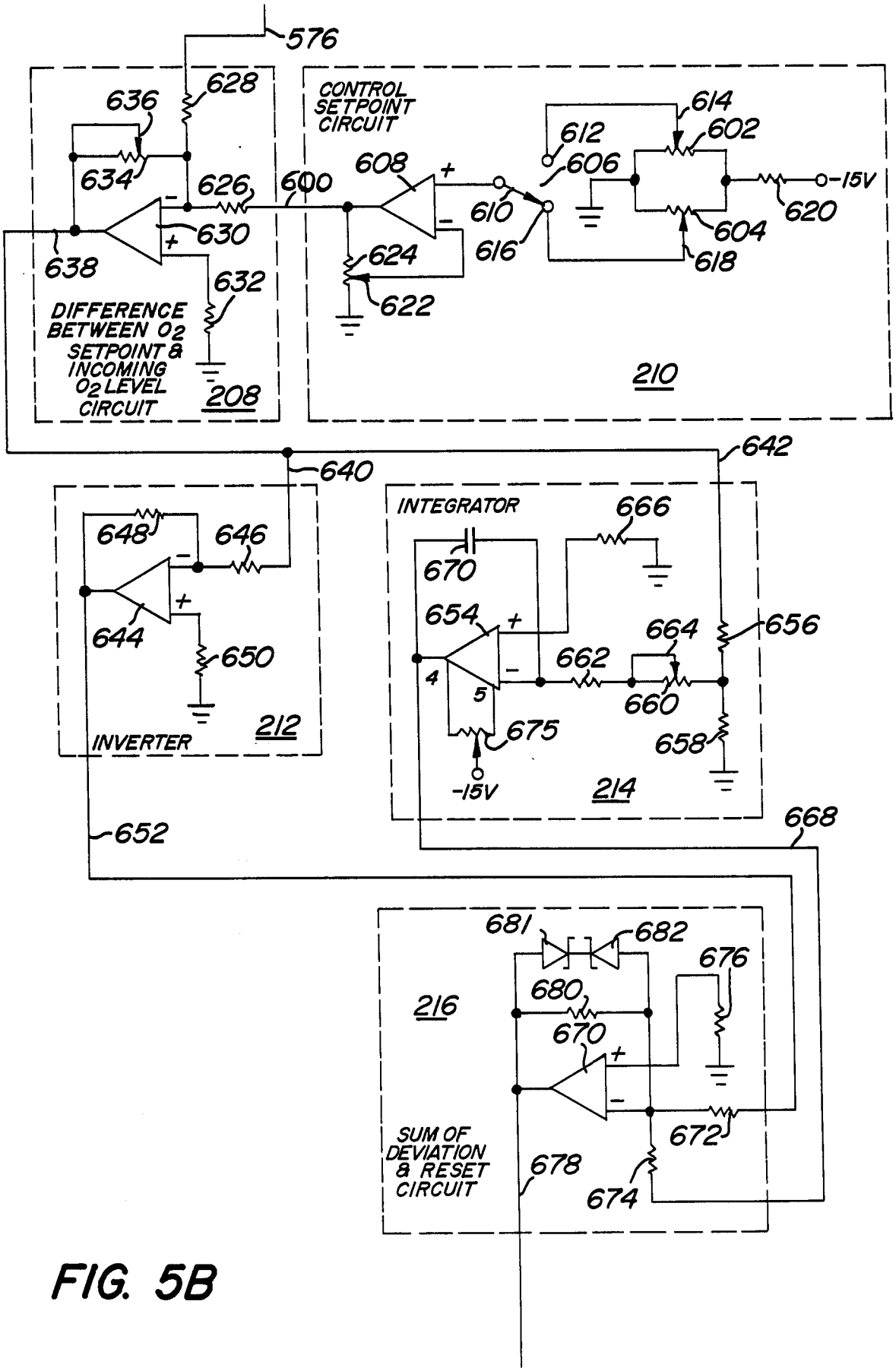

The linearized oxygen signal appearing on line 576 is provided as an input to the Difference Between Oxygen Setpoint And Incoming Oxygen Level Circuit 208 as shown in FIG. 5B. Another input is provided to the circuit 208 from line 600. Line 600 is the output from the Control Setpoint Circuit 210. As can be seen, the Control Setpoint Circuit comprises a pair of potentiometers 602 and 604 coupled through a switch 606 to an operational amplifier 608. Operational amplifier 608 is preferably another portion of the combined integrated circuit pack forming amplifiers 524 and 584. The switch 606 includes a movable contactor 610 which is connected to the non-inverting input terminal of amplifier 608. The switch 606 also includes one stationary contact 612 which is connected to the wiper arm 614 of potentiometer 602 and another stationary contact 616 which is connected to the wiper arm 618 of potentiometer 604. One side of potentiometer 602 is connected to the corresponding side of potentiometer 604 and to ground while the opposite sides of potentiometers 602 and 604 are connected to one side of a resistor 620. The other side of resistor 620 is connected to a −15V bus. The inverting input terminal of circuit 608 is connected to wiper arm 622 of a potentiometer 624. The potentiometer 624 is connected between ground and the common junction of line 600 and the output terminal of the integrated circuit 608.

The potentiometer 602 serves to establish the setpoint for gas (assuming that the device of the instant invention is used in a gas fired system) while the potentiometer 604 establishes the setpoint for oil fired systems. To that end, the knob 148 is connected to wiper arm 618 of potentiometer 604 while knob 150 is connected to the wiper arm 614 of potentiometer 602. When the device of the instant invention is used to control an oil fired system the switch 606 is moved to the position shown in FIG. 5B whereupon movable contact 610 connects the non-inverting input of integrated circuit 608 to the wiper arm 618 of the oil setpoint potentiometer 604 to establish the setpoint for the system. The resistor 620 drops the voltages appearing on the potentiometers 602 and 604. The operational amplifier 608 is set up as a voltage follower with the potentiometer 624 establishing its gain. The signal appearing at the output of circuit 608 is the control setpoint signal and indicates the desired oxygen level the system is to maintain. This signal appears on line 600 as an input to the Difference Between Oxygen Setpoint And Incoming Oxygen Level Circuit 208.

The circuit 208 comprises a pair of input resistors 626 and 628. Resistor 626 is connected to input line 600 from the Control Setpoint Circuit 210 and resistor 628 is connected to input line 576 from the Two Decade Antilog Amplifier 204. As can be seen in FIG. 5B, resistors 626 and 628 are connected together at a summing junction to the inverting input terminal of an operational amplifier 630. The operational amplifier 630 is preferably yet another portion of the combined integrated circuit pack forming amplifiers 524, 584 and 608. The non-inverting input terminal of amplifier 630 is connected to one side of a resistor 632, the other side of which is connected to ground. A potentiometer 634 is connected between the output of the amplifier 630 and its inverting input terminal. The wiper arm 636 of potentiometer 634 is connected to the common junction of the output terminal of the amplifier 630 and the output line 638.

As will be appreciated by those skilled in the art, the control setpoint signal appearing on resistor 626 and the linear voltage signal indicating the sensed oxygen level appearing on resistor 628 are summed at the inverting input terminal of operational amplifier 630. The amplifier is set up as an inverting amplifier whose gain is established by the setting of potentiometer 634. The resistor 632 performs the same function as resistor 528 described heretofore.

The signal appearing on line 638 thus comprises an error signal equal to the difference between the setpoint oxygen level and the monitored oxygen level. The error signal appearing on line 638 is provided to the Inverter Circuit 212, via connecting line 640 and to the Integrator Circuit 214, via connecting line 642.

As can be seen, the Inverter Circuit 212 includes an operational amplifier 644. Amplifier 644 is preferably one portion of a combined integrated circuit pack such as the Raytheon Model RC4236. The input line 640 is connected to one side of a resistor 646. The other side of the resistor 646 is connected to the inverting input terminal of the operational amplifier 644. A resistor 648 is connected between the inverting input terminal and the output terminal of the operational amplifier. The non-inverting input terminal of the operational amplifier 644 is connected to ground, via a resistor 650, while its output is connected to line 652.

The signal provided on line 640 passes, via resistor 646 to the inverting input of the operational amplifier 644. This operational amplifier is set up as an inverting amplifier whose gain is established by the ratio of resistors 648/646. The resistor 650 serves the same function as resistor 528 described heretofore.

Line 642 serves as the input to the Integrator Circuit 214. As noted heretofore, this circuit is arranged to perform real time integration on the error signal appearing at the input to thus provide automatic reset control. The Integrator Circuit 214 includes an operational amplifier 654. In accordance with the preferred embodiment of this invention the amplifier 654 is a National Semiconductor Model LH0042CH. The input to the integrator 214 is provided, via line 642 connected to one side of a resistor 656. The other side of resistor 656 is connected to the common junction of a resistor 658 and a potentiometer 660. The other side of resistor 658 is connected to ground. The other side of potentiometer 660 is connected to one side of a resistor 662 and to the wiper arm 664 of the potentiometer 660. The other side of resistor 662 is connected to the inverting input terminal of the operational amplifier 654. A resistor 666 is connected between ground and the positive input terminal to operational amplifier 654. The output of operational amplifier 654 is provided on line 668. A capacitor 670 is connected between the output line 668 and the inverting input terminal of the operational amplifier 654. A nulling potentiometer 675 is connected between pins 4 and 5 of the operational amplifier 654. The wiper arm of potentiometer 675 is connected to a −15V bus.

As should be appreciated by thos skilled in the art, resistors 656 and 658 form a voltage divider. The operational amplifier 654 generates a ramp signal, the slope of which is the reset rate established by the voltage divider. The potentiometer 675 serves to null and offset voltage generated interally within the amplifier 654. The capacitor 670 serves as the integrator capacitor, with rate of integration determined by the product of the value of capacitor 670 and the total resistance of resistors 660 and 662.

The output of the Integrator Circuit 214 is provided on line 688 and is a ramp signal having a positive slope when the input to the inverting terminal of operation amplifier 654 is negative. When the input to the inverting terminal is zero the output is a fixed voltage and when the input to the inverting terminal is positive the ramp has a negative slope.

Line 668 carrying the output of the Integrator Circuit 214 serves as one input to the Sum Of Deviation And Reset Circuit 216. The other input to the circuit 216 is provided via line 652 from the Inverter Circuit 212. The circuit 216 includes an operational amplifier 670. In accordance with a preferred embodiment the amplifier 670 forms another portion of a combined integrated circuit forming operational amplifier 644. The input from the Inverter Circuit and appearing on line 652 is connected, via a resistor 672, to the inverting input terminal of the operational amplifier 670. Similarly the input from line 668 is connected via resistor 674 to the inverting terminal of operational amplifier 670. A resistor 676 is connected between ground and the non-inverting input terminal of operational amplifier 670. The output of operational amplifier 670 is provided on line 678. A resistor 680 is connected between the inverting input terminal of the operational amplifier and its output line 678. An opposed pair of zener diodes 681 and 682 are connected in series across resistor 680.

The resistors 672 and 674 form a summing network connected to the inverting input of the operational amplifier 670. The amplifier serves as an inverting amplifier whose gain is established by the ratio of resistor 680 to resistors 672 and 674. The parallel connected, back-to-back zener diodes 681 and 682 clip the voltage appearing across resistor 680 between plus and minus 10V. The output of the Sum Of Deviation And Reset Circuit 216 is provided on line 678 to the Output Range Adjust Circuit 218.

Figure 5C:
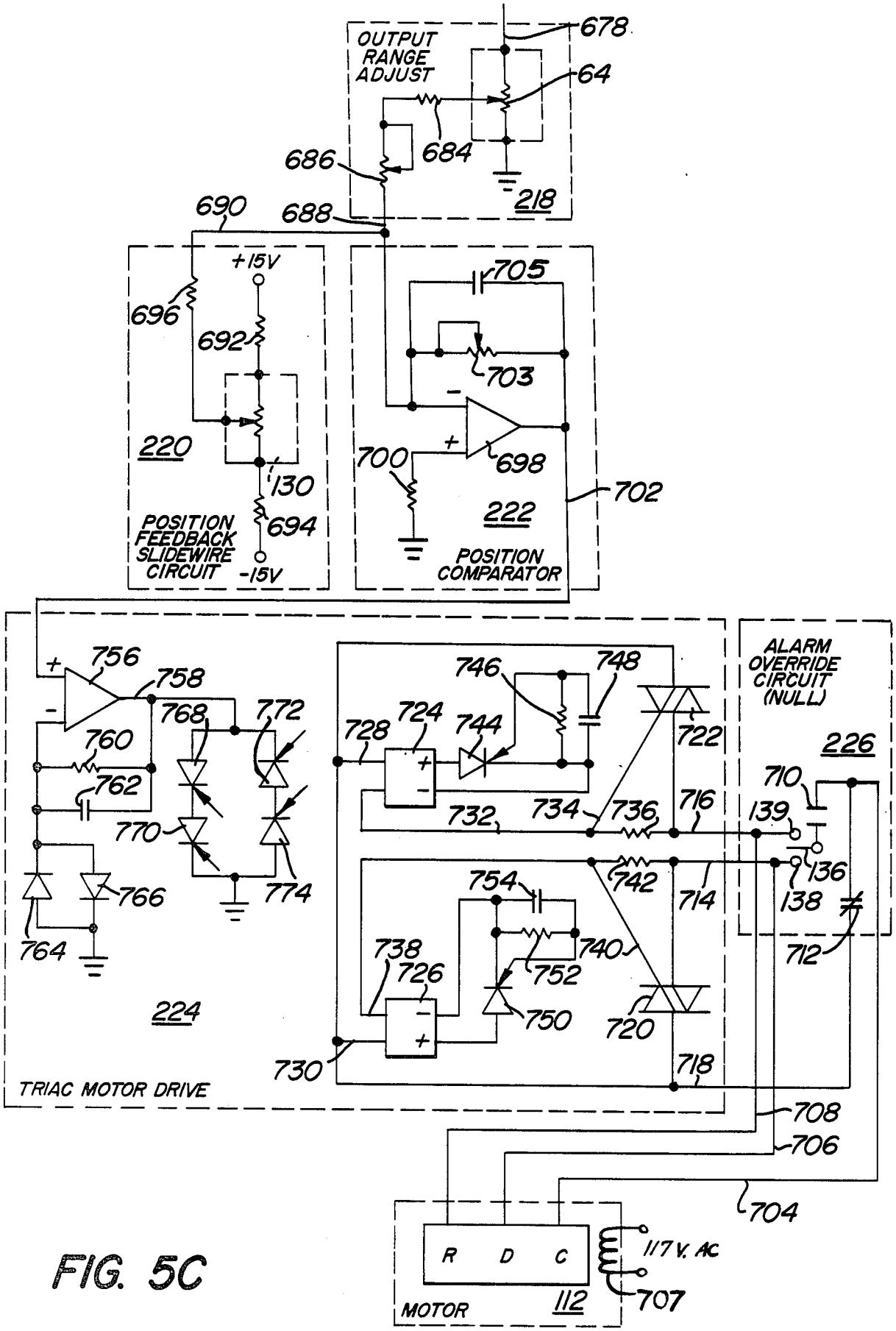

The Output Range Adjust Circuit is shown in FIG. 5C and includes the shaft position potentiometer 64 connected between line 678 and ground. The wiper arm of potentiometer 64 is connected to one side of a resistor 684. The other side of resistor 684 is connected to one side of a manual travel limit potentiometer 686 and its wiper arm. The travel knob 144 in the electronics package is connected to the wiper arm of potentiometer 686. The other side of potentiometer 686 is connected to output line 688 of the Output Range Adjust Circuit 218.

The resistor 684 provides proper ratioing of the current provided through potentiometer 686 to output line 688.

As described heretofore, the shaft position potentiometer 64 is mounted for cooperative movement with the input shaft 16 and is arranged to provice zero gain at early rotational positions, that is at low fire positions. The gain of the potentiometer increases as the rotational position of the shaft increases.

The output of the shaft position potentiometer serves as an input to the manual travel limit adjustment potentiometer 686. This potentiometer establishes the amount of vernier or differential movement the differential controller 12 is capable of effecting.

The output signal appearing on line 688 serves as one input to the Position Comparator Circuit 222. The other input to the Position Comparator Circuit 222 is provided via line 690 which is output line of the Position Feedback Slide Wire Circuit 220.

The circuit 220 basically comprises the position feedback potentiometer 130 described heretofore. To that end can be seen, the slide wire potentiometer 130 is connected between a pair of resistors 692 and 694. One side of resistor 692 is connected to a +15V bus while the corresponding side of resistor 694 is connected to a −15V bus. The wiper of the position feedback potentiometer 130 is connected, via resistor 696, to output line 690.

The Position Feedback Slide Wire Circuit 220 is arranged to provide an output voltage which is a function of the differential position of the output shaft. Resistors 692 and 694 drop the voltage across the potentiometer 130 to the desired range. The resistor 696 provides proper ratioing of the current provided through line 690.

The Position Comparator Circuit 222 basically comprises an operational amplifier 698. In accordance with a preferred aspect of this invention operational amplifier 698 forms another portion of the combined integrated circuit pack forming the operational amplifiers 644 and 670. The input line 688 from the Output Range Adjust Circuit 218 and input line 690 from the Position Feedback Slide Wire Circuit 220 are connected together at the inverting input terminal of the operational amplifier 698. A resistor 700 is connected between ground and the non-inverting input terminal of operational amplifier 698. The output of operational amplifier 698 is provided on line 702. A potentiometer 703 is connected between the inverting input terminal of operational amplifier 698 and output line 702. A capacitor 705 is connected in shunt across the potentiometer 704.

As should be appreciated, the operational amplifier 698 is set up as an inverting amplifier whose gain is established by potentiometer 703. The capacitor 705 serves as a noise filter and response limiter. The gain of the amplifier sets the sensitivity of the output provided on line 702 to the Triac Motor Drive Circuit 224.

Before discussing the construction of the Triac Motor Drive Circuit 224 a description of the motor 112 and the Alarm Override Circuit 226 is in order. The motor 112 is a five wire motor such as sold by the Barber-Coleman Company of Rocksford, Ill., Model KE12814. The motor is arranged such that alternating current is induced within its windings from a constantly energized field winding 707 and provided through the Alarm Override Circuit to terminal C of the motor when there is "no alarm" condition. The motor is arranged to receive alternating current on either of its terminals R or D when its associated winding is shorted to the common terminal C. The shorting between the common terminal C and terminals R and D occurs in the Triac Motor Drive Circuit 224, as will be described later.

The operation of the motor is as follows: when the triac motor drive shorts out the R connection winding of the motor to the common or C connection the motor rotates in the counter-clockwise direction. Conversely, when the triac motor drive circuit 224 shorts the D connection winding with the common or C connection the motor rotates in the clockwise direction.

As can be seen, the C connection of motor 112 is connected via line 704 to the alarm override circuit 226. The D winding connection is connected via line 706 to circuit 226 and the R winding connection of the motor 112 is connected via line 708 to the circuit 226.

The circuit 226 includes the nulling switch formed by movable contacts 136 and stationary contacts 138 and 139, described heretofore, a pair of normally open relay contacts 710 and a pair of normally closed relay contacts 712. The contacts 710 and 712 are actuated by the alarm relay coil 598 in the Alarm Setpoint Comparator Circuit 206.

The line 706 is connected to output line 714 of the Triac Motor Drive and line 708 is connected to output line 716 of the Triac Motor Drive. The normally open contacts 710 are connected between the movable contact 136 of the nulling switch and line 704 connected to the C terminal of the motor. The normally closed contacts 712 are connected between the line 704 and output line 718 of the Triac Motor Drive.

As will be described in detail later, the Triac Motor Drive is arranged to short line 714 to 718, thereby shorting the C terminal connection of the motor to its D terminal, via the closed contacts 712 of the Alarm Override Circuit 226, to effect the clockwise rotation of the motor in a "non-alarm" condition. Similarly the motor drive 224 is arranged to short the C and R connections of the motor 112 via lines 716 and 718 and the closed contacts 712 of the Alarm Override Circuit 226 to the effect the counter-clockwise rotation of the motor in a "non-alarm" condition.

Upon the occurrence of an alarm condition, as described heretofore, relay 598 is deenergized, thereby causing relay contacts 712 to open and contacts 710 to close. The opening of contacts 712 precludes the Triac Motor Drive from effecting the rotation of the motor. In an alarm condition the common contact 136 of the nulling switch would be in contact with either contacts 138 and 139, and hence to the D or R winding contact of the motor, depending on the last positioning of the output shaft 18 immediately prior to the occurrence of the alarm condition. If the movable contact 136 is in electrical contact with the R connection of the motor 112, via line 708, there is a short in the motor windings between the R and C contact, via line 704 and the now closed contacts 710. This action causes the motor 112 to rotate counter-clockwise. When the rotation of the motor causes the movable contact 136 of the nulling switch to move away from stationary contacts 139 the connection is broken between the R and C contacts of the motor 112 and the motor stops rotating. Accordingly, the shaft 18 is returned to its null position with respect to shaft 16. The clockwise rotation of the motor to its null position occurs in a similar manner.

The Triac Motor Drive Circuit 224 basically comprises a pair of triacs one of which, denoted by the reference numeral 720, being connected between output lines 714 and 718 and the other triac, 722, being connected between output lines 716 and 718. When triac 720 is rendered conductive, as will be described later, lines 714 and 718 are shorted together. When triac 722 is rendered conductive lines 716 and 718 are shorted together.

Alternating current is provided to the triac gates from the coupled motor 112, via a pair of bridge rectifiers 724 and 726. The rectifiers 724 and 726 are preferably Varo Semiconductor Model VM48 and are in the power supply circuit for the differential controller which will be described in detail with regard to FIG. 6. Suffice for now to say that one AC terminal 728 of bridge 724 and one AC terminal 730 of bridge 726 are connected together to line 718. Another AC terminal 732 of bridge 724 is connected to the gate electrode 734 of triac 722. A resistor 736 is connected between the gate electrode 734 and line 716. Similarly, the other AC terminal, 738, of bridge rectifier 726 is connected to the gate electrode 740 of triac 720. A resistor 742 is connected between gate electrode 740 and line 714. The resistors 736 and 742 preclude noise from triggering the triacs 722 and 720, respectively. As can be seen, the anode of a photoactuated SCR 744 is connected to the positive DC terminal of bridge 724. The parallel combination of a resistor 746 and a capacitor 748 is connected between the gate electrode and the cathode of SCR 744. The cathode of SCR 744 is also connected to the negative DC terminal of bridge rectifier 724. Similarly, the anode of another photoactuated SCR 750 is connected to the positive DC terminal of bridge rectifier 726. The parallel combination of a resistor 752 and a capacitor 754 is connected between the gate electrode and the cathode of SCR 750. The cathode of SCR 750 is also connected to the negative DC terminal of bridge rectifier 726.

As will be appreciated by those skilled in the art, the receipt of light by photoactuated SCR 750 causes the triggering of SCR 720, via its gate electrode 740, while the light actuation of SCR 744 causes the gating of triac 722 via its the gate electrice 734.

The light actuation of SCRs 744 and 750 is accomplished by the remaining portion of the Triac Motor Drive Circuit, to be described hereinafter, which portion receives its actuating signals via line 702 from the Position Comparator Circuit 222. To that end, line 702 serves as an input to a non-inverting input terminal of an operational amplifier 756 within the Triac Motor Drive Circuit 224. The operational amplifier 756 forms still another portion of the combined integrated circuit pack forming operational amplifiers 698, 670 and 644. The output of operational amplifier 756 is provided at line 758. The parallel combination of a resistor 760 and a capacitor 762 is connected between the inverting input terminal of the operational amplifier 756 and output line 758. An inversely connected pair of diodes 764 and 766 is connected between the inverting input terminal of the operational amplifier 756 and ground. A serially connected pair of light emitting diodes 768 and 770 are connected between output line 758 and ground. Another serially connected pair of light emitting diodes 772 and 774 are connected in inverse parallel relationship with diodes 768 and 770.

As will be appreciated by those skilled in the art, integrated circuit 756 is set up as a voltage comparator with diodes 764 and 766 providing a dead band in the output. The resistor 760 serves as the feedback resistor to prevent false triggering and dead band, while capacitor 762 limits the speed at which the comparator changes. The output and inverting input terminal of operational amplifier 756 follow the inverting input terminal until either diode 764 and 766 begin to conduct. When the input to the non-inverting input terminal is positive and of sufficient magnitude such that 766 begins to conduct the output of operational amplifier 756 goes to the positive bus level. When the input to operational amplifier 756 at its non-inverting terminal is negative and low enough such that diode 764 conducts the output of amplifier 756 goes to the negative bus potential. The positive bus potential appearing on line 758 causes diodes 768 and 770 to conduct, thereby giving off light and triggering the associated photoresponsive SCR 750 into conduction. When the output 758 of the operational amplifier goes to the negative bus potential diodes 772 and 774 conduct, thereby triggering the associated photoactuated SCR 744 into conduction.

Turning now to FIG. 6 there is shown the details of the power supply for the differential controller 12. As can be seen therein the power supply includes a transformer 776 including a primary winding 778 adapted to be connected to conventional 110V, 60 cycle AC power and a pair of secondary windings 780 and 782. The winding 780 serves as the AC input to the bridge rectifier 724, while secondary 782 serves as the AC input to bridge rectifier 726. The positive DC terminal of rectifier 724 is connected via a voltage regulator 786 to provide a +15V to a bus while the negative DC terminal of rectifier 726 is connected via a voltage regulator 792 to provide a regulate −15V to a bus. In accordance with the preferred embodiment of the instant invention the voltage regulators 786 and 792 are each National Semi-conductor Model LM340-15. The negative DC terminal of rectifier 724 is connected to ground. The positive DC terminal of rectifier 724 is connected to one side of a capacitor 784 and to pin 1 of the voltage regulator 786. Pin 2 of the voltage regulator 786 is connected to the other side of capacitor 784 and to the negative DC terminal of the rectifier 724. Pin 3 of the regulator 786 is connected to the +15V bus. Another capacitor 788 is connected between the +15V bus and ground. In a similar manner a capacitor 790 is connected between the positive and negative DC terminals of bridge rectifier 726, while pin 1 of the voltage regulator 792 is connected to the positive DC terminal of rectifier 726. The Pin 2 of the regulator 792 is connected to the negative DC terminal of bridge rectifier 726 while its Pin 3 is connected to ground. Another capacitor 794 is connected between ground the −15V bus.

As should be appreciated by those skilled in the art, the capacitors in the power supply portion shown in FIG. 6 provide a filtering function and improve transient response.

The regulated +15V bus voltage and the regulated −15V bus voltage are provided to the integrated circuits in the electronics package 56 as follows: integrated circuit 516 is connected to the +15V bus via its pin 7 and to the −15V bus via its pin 4, the integrated circuit forming the operational amplifiers 524, 584, 608 and 630 is connected to the +15V bus via pin 11 and to the −15V bus via pin 7, the integrated circuit 654 is connected to the +15V bus via its pin 7 and to the −15V bus via its pin 4 and the integrated circuit forming operational amplifiers 664, 670, 698 and 756 is connected to the +15V bus via its pin 11 and to the −15V bus via its pin 7.

The following table is indicative of various component values for the electronics package 56. The values for resistor and potentiometer components are given in kilohms and the value of capacitors in microfarads, unless otherwise shown. Solid state components are identified by their manufacturer and/or identification numbers:

| COMPONENTS | |
|---|---|
| REFERENCE NO. | VALUE/IDENTIFICATION |
| 64 | 1000 ohms |
| 504 | 100 ohms |
| 506 | 100 |
| 508 | 100 |
| 512 | 100 |
| 520 | 10 |
| 524 | 100 |
| 528 | 4.7 |
| 530 | 30 |
| 532 | 10 |
| 538 | 10 |
| 542 | 4.7 |
| 548 | 10 |
| 552 | 15 |
| 554 | 100 |
| 556 | 680 ohms |
| 560 | 10 |
| 562 | 62 |
| 564 | 62 |
| 566 | 10 |
| 570 | 10 |
| 578 | 10 |
| 588 | 250 |
| 590 | 22 |
| 602 | 250 |
| 604 | 250 |
| 620 | 22 |
| 624 | 10 |
| 626 | 10 |
| 628 | 10 |
| 632 | 4.7 |
| 634 | 1M |
| 646 | 10 |
| 648 | 10 |
| 650 | 4.7 |
| 656 | 43 |
| 658 | 4.7 |
| 660 | 1 Meg. Ohm |
| 666 | 10 |
| 672 | 30 |
| 674 | 30 |
| 675 | 10 |
| 676 | 4.7 |
| 680 | 22 |
| 684 | 33 |
| 686 | 250 |
| 692 | 2.2 |
| 694 | 2.2 |
| 696 | 10 |
| 700 | 4.7 |
| 703 | 1 Meg. Ohm |
| 736 | 1.1 |
| 742 | 1.1 |
| 746 | 30 |
| 752 | 30 |
| 760 | 10 |
| 510 | .005 |
| 522 | .005 |
| 550 | 200 pf |
| 580 | .1 |
| 594 | 33 |
| 670 | 5 |
| 705 | .1 |
| 748 | .005 |
| 754 | .005 |
| 762 | .1 |
| 784 | 1000 |
| 788 | 1 |
| 790 | 1000 |
| 794 | 1 |
| 764 | 1N4004 |
| 766 | 1N4004 |
| 681 | 1N4740 |
| 682 | 1N4740 |

-continued

| COMPONENTS | |
|---|---|
| REFERENCE NO. | VALUE/IDENTIFICATION |
| 768 | MC54200 |
| 770 | MC54200 |
| 772 | MC54200 |
| 774 | MC54200 |
| 596 | 2N3053 |
| 544 | Intersil 8049 |
| 724 | Varo Semiconductors VM48 |
| 726 | Varo Semiconductors VM48 |
| 516 | RCA - CA3140 |
| 524 | Raytheon - RC4136 |
| 584 | Raytheon - RC4136 |
| 608 | Raytheon - RC4136 |
| 630 | Raytheon - RC4136 |
| 654 | National Semiconductor LH0042CH |
| 644 | Raytheon - RC4136 |
| 670 | Raytheon - RC4136 |
| 698 | Raytheon - RC4136 |
| 756 | Raytheon - RC4136 |
| 786 | National LM-340T-15 |
| 792 | National LM-340T-15 |

As should be appreciated from the foregoing, the controller of the instant invention provides the advantages of a simple, mechanically linked system for the input and output shafts, yet air flow is always automatically adjusted to maintain optimum fuel-air ratio by direct measurements of the oxygen content in the stack. The device compenstates for variations in fuel viscosity, BTU content, combustion air density and the like. It eliminates the wasted fuel required to maintain the constant safety margin in the fuel-air ratio. Other important features of the controller are its failsafe circuitry operative in the even of an alarm condition, a calibrated control setpoint, a calibrated alarm setpoint, adjustable differential travel limits, internal linearization of logarithmic signals from oxygen analyzers providing logarithmic signals and the use of dual setpoints for dual fuel systems (e.g., gas and oil).

It should be pointed out at this juncture that while a preferred embodiment of the invention disclosed herein makes use of circuitry for linearizing a transmitted oxygen signal and for interfacing the linearized signal with the control circuitry, it is clear that such interfacing and linearization circuitry can be eliminated in systems wherein the transmitted oxygen signal is compatible with the control circuitry of the differential controller of the instant invention. Furthermore, while no specific alarm annunciating means have been disclosed herein, it is clear that any type of annunciating means can be utilized in conjunction with the alarm relay to provide either a visual or audible or combined signal indicating the existence of an alarm condition. Finally, it should be pointed out that the differential controller of the instant invention is not limited to oil fired or gas fired burner combusion systems. As is known in burning wood and other waste products, fuel composition is highly variable. Accordingly, the differential controller has suitable application in waste fuel applications wherein conventional proportional control could not cope with fuel variations.

Without further elaboration, the foregoing will so fully illustrate my invention that others may, by applying current or future knowledge, readily adapt the same for use under various conditions of service.

What is claimed as the invention is:

1. In a combustion control system including a stack through which products of combustion pass, a first rotating shaft portion coupled to means for adjusting the flow of fuel through a fuel valve and a second rotating shaft portion coupled to means for adjusting the flow of air through a damper, said first and second shaft portions being arranged to rotate together from a low fire position to a high fire position to establish the fuel and air flows from all positions therebetween, a differential controller providing relative vernier rotation between said first and second shaft portions to enable said fuel to be burned efficiently irrespective of changes in the fuel or air provided, said differential controller comprising means for comparing the oxygen level in the stack with a preselected oxygen level and for effecting the vernier rotation of said second shaft portion with respect to said first shaft portion when there is a deviation from said preselected oxygen level to adjust the oxygen level to said preselected level, means for adjusting the gain of said differential controller to enable greater vernier rotation as the first shaft portion is rotated from the low fire position to higher fire positions and override means to cause said second shaft portion to assume a predetermined null position with respect to said first shaft portion in response to an alarm condition.

2. In the system of claim 1, said differential controller including means for establishing an alarm signal when the oxygen level in said stack drops below a predetermined level.

3. In the system of claim 2 wherein said alarm signal producing means also provides said alarm signal in response to the detection of a malfunction in the differential controller.

4. In the system of claim 1 wherein said null position is adjustable.

5. In the system of claim 1 wherein means are provided to limit the maximum degree of vernier rotation between said first and second shaft portions.

6. In the system of claim 1 wherein said system includes oxygen level sensing means providing a logarithmic signal indicative of said oxygen level, said differential controller including antilog amplifier means for linearizing said signal and for providing said linearized signal to means for comparing said signal to a preselected signal indicative of an alarm condition.

7. In the system of claim 6, said controller also comprising means for producing an error signal equal to the difference between a preselected oxygen level signal and the linear oxygen level signal.

8. In the system of claim 1 wherein said system includes oxygen level sensing means providing a signal indicative of said oxygen level, said differential controller including means for providing a linear oxygen level indicating signal to means for comparing said signal to a preselected signal indicative of an alarm condition.

9. In the system of claim 8, said controller also comprising means for producing an error signal equal to the difference between a preselected oxygen level signal and the linear oxygen level signal.

10. In the system of claim 7, said differential controller also comprising means for producing a control signal including one component which is proportional to said error signal and the other component is proportional to the real time integral of said error signal, said control signal being provided to output range adjusting means for providing an output signal indicative of the vernier rotation to be assumed by said first and second shaft portions, position comparator means responsive to said output position signal and means providing a signal indicating the existing rotational relationship between said first and second shaft portions to provide a signal to motor means for effecting the relative vernier rotation between said first and second shaft portions.

11. In the system of claim 9 wherein said output range adjusting means includes means for varying the gain of said output range adjusting means in response to a signal indicative of the rotational position of said first shaft means.

12. In the system of claim 10 wherein the output range adjusting means comprises means for limiting the permissible range of the output signal to preselected limits.

13. In the system of claim 11 wherein the output range adjusting means comprises means for limiting the permissible range of the output signal to preselected limits.

14. In the system of claim 1 wherein said differential controller includes a motor for effecting the relative vernier rotation between said first and second shaft portions, said motor being mounted on support means fixedly secured to one of said shaft portions and coupled through gear means to the other of said shaft portions.

15. In the system of claim 14 wherein said override means includes a double throw switch having a movable contactor and a pair of stationary contacts with the pair of contacts being fixedly secured to one shaft portion and the movable contactor being fixedly secured to the other shaft portion to establish said null position when said movable contactor is in the position intermediate said stationary contacts.

16. In the system of claim 15 additionally comprising potentiometer means coupled to said first shaft portion to provide a signal indicative of the rotational position of said first shaft portion.

17. In the system of claim 16 wherein said controller also comprises potentiometer means coupled to said gear means to provide a signal indicative of the rotational position of the second shaft portion with respect to said first shaft portion.

18. In the system of claim 17 wherein said differential controller is enclosed within a sealable housing.

* * * * *